US010760346B2

(12) United States Patent
Schroder et al.

(10) Patent No.: US 10,760,346 B2
(45) Date of Patent: Sep. 1, 2020

(54) ROTATABLE CUTTERS AND ELEMENTS, EARTH-BORING TOOLS INCLUDING THE SAME, AND RELATED METHODS

(71) Applicant: Baker Hughes, a GE company, LLC, Houston, TX (US)

(72) Inventors: Jon David Schroder, The Woodlands, TX (US); John Abhishek Raj Bomidi, Spring, TX (US); Kegan L. Lovelace, Houston, TX (US); William A. Moss, Jr., Conroe, TX (US); Alexander Rodney Boehm, Wheat Ridge, CO (US)

(73) Assignee: Baker Hughes, a GE company, LLC, Houston, TX (US)

( * ) Notice: Subject to any disclaimer, the term of this patent is extended or adjusted under 35 U.S.C. 154(b) by 120 days.

(21) Appl. No.: 15/662,603

(22) Filed: Jul. 28, 2017

(65) Prior Publication Data

US 2019/0032417 A1 Jan. 31, 2019

(51) Int. Cl.

| | |
|---|---|
| ***E21B 10/62*** | (2006.01) |
| ***E21B 10/42*** | (2006.01) |
| ***E21B 10/573*** | (2006.01) |
| ***E21B 10/55*** | (2006.01) |
| ***E21B 10/54*** | (2006.01) |

(52) U.S. Cl.

CPC ..... *E21B 10/62* (2013.01); *E21B 10/42* (2013.01); *E21B 10/55* (2013.01); *E21B 10/573* (2013.01); *E21B 10/54* (2013.01)

(58) Field of Classification Search

CPC ..... E21B 10/62; E21B 10/42; E21B 10/54

See application file for complete search history.

(56) References Cited

U.S. PATENT DOCUMENTS

| | | | |
|---|---|---|---|
| 4,553,615 | A | 11/1985 | Grainger |
| 4,751,972 | A | 6/1988 | Jones et al. |
| 7,604,073 | B2 | 10/2009 | Cooley et al. |
| 7,703,559 | B2 | 4/2010 | Shen et al. |
| 7,762,359 | B1 | 7/2010 | Miess |
| 7,845,436 | B2 | 12/2010 | Cooley et al. |
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,091,655 | B2 | 1/2012 | Shen et al. |

(Continued)

FOREIGN PATENT DOCUMENTS

| | | |
|---|---|---|
| WO | 2016/081807 A1 | 5/2016 |
| WO | 2017/058581 A1 | 4/2017 |

OTHER PUBLICATIONS

International Written Opinion for International Application No. PCT/US2018/043617 dated Nov. 9, 2018, 11 pages.

(Continued)

*Primary Examiner* — Giovanna Wright
*Assistant Examiner* — Manuel C Portocarrero
(74) *Attorney, Agent, or Firm* — TraskBritt

(57) ABSTRACT

A rotatable cutter may comprise a rotatable element, a stationary element, and a releasable interface. The releasable interface may be configured to substantially inhibit rotation of the rotatable element when the rotatable element and the stationary element are at least in partial contact. An earth-boring tool may include one or more rotatable elements.

20 Claims, 5 Drawing Sheets

(56) References Cited

U.S. PATENT DOCUMENTS

| | | | |
|---|---|---|---|
| 8,210,285 | B2 | 7/2012 | Cooley et al. |
| 8,413,746 | B2 | 4/2013 | Shen et al. |
| 8,561,728 | B2 | 10/2013 | Cooley et al. |
| 8,800,691 | B2 | 8/2014 | Shen et al. |
| 8,881,849 | B2 | 11/2014 | Shen et al. |
| 8,931,582 | B2 | 1/2015 | Cooley et al. |
| 8,950,516 | B2 | 2/2015 | Newman |
| 8,973,684 | B1 | 3/2015 | Cooley et al. |
| 8,991,523 | B2 | 3/2015 | Shen et al. |
| 9,016,409 | B2 | 4/2015 | Zhang et al. |
| 9,033,070 | B2 | 5/2015 | Shen et al. |
| 9,187,962 | B2 | 11/2015 | Burhan et al. |
| 9,279,294 | B1 | 3/2016 | Cooley et al. |
| 9,291,000 | B2 | 3/2016 | Zhang et al. |
| 9,322,219 | B2 | 4/2016 | Burhan et al. |
| 9,328,564 | B2 | 5/2016 | Zhang et al. |
| 9,382,762 | B2 | 7/2016 | Cooley et al. |
| 9,388,639 | B2 | 7/2016 | Patel et al. |
| 9,464,486 | B2 | 10/2016 | Zhang et al. |
| 2008/0251293 | A1 | 10/2008 | Mumma et al. |
| 2014/0054094 | A1 | 2/2014 | Burhan et al. |
| 2014/0131118 | A1 | 5/2014 | Chen et al. |
| 2014/0251692 | A1* | 9/2014 | McKay ..... E21B 17/1078 175/57 |
| 2014/0326515 | A1 | 11/2014 | Shi et al. |
| 2014/0326516 | A1 | 11/2014 | Haugvaldstad et al. |
| 2014/0360789 | A1 | 12/2014 | Siracki et al. |
| 2014/0360792 | A1 | 12/2014 | Azar et al. |
| 2015/0047910 | A1 | 2/2015 | Chen et al. |
| 2015/0129310 | A1* | 5/2015 | Newman ..... E21B 10/62 175/57 |
| 2016/0290056 | A1 | 10/2016 | Propes et al. |
| 2017/0191317 | A1 | 7/2017 | Burhan et al. |
| 2019/0032410 | A1 | 1/2019 | Moss, Jr. et al. |
| 2019/0032418 | A1 | 1/2019 | Schroder et al. |

OTHER PUBLICATIONS

International Search Report for International Application No. PCT/US2018/043617 dated Nov. 9, 2018, 3 pages.

* cited by examiner

ROTATABLE CUTTERS AND ELEMENTS, EARTH-BORING TOOLS INCLUDING THE SAME, AND RELATED METHODS

TECHNICAL FIELD

Embodiments of the present disclosure generally relate to devices and methods involving cutting and other rotatable elements for earth-boring tools used in earth boring operations and, more specifically, to cutting elements for earth-boring tools that may rotate in order to alter the rotational positioning of the cutting edge and cutting face of the cutting element relative to an earth-boring tool to which the cutting element is coupled, to earth-boring tools so equipped, and to related methods.

BACKGROUND

Various earth-boring tools such as rotary drill bits (including roller cone bits and fixed-cutter or drag bits), core bits, eccentric bits, bi-center bits, reamers, and mills are commonly used in forming bore holes or wells in earth formations. Such tools often may include one or more cutting elements on a formation-engagement surface thereof for removing formation material as the earth-boring tool is rotated or otherwise moved within the borehole.

For example, fixed-cutter bits (often referred to as "drag" bits) have a plurality of cutting elements affixed or otherwise secured to a face (i.e., a formation-engagement surface) of a bit body. Cutting elements generally include a cutting surface, where the cutting surface is usually formed out of a superabrasive material, such as mutually bound particles of polycrystalline diamond. The cutting surface is generally formed on and bonded to a supporting substrate of a hard material such as cemented tungsten carbide. During a drilling operation, a portion of a cutting edge, which is at least partially defined by the peripheral portion of the cutting surface, is pressed into the formation. As the earth-boring tool moves relative to the formation, the cutting element is dragged across the surface of the formation and the cutting edge of the cutting surface shears away formation material. Such cutting elements are often referred to as "polycrystalline diamond compact" (PDC) cutting elements, or cutters.

During drilling, cutting elements are subjected to high temperatures due to friction between the cutting surface and the formation being cut, high axial loads from the weight on bit (WOB), and high impact forces attributable to variations in WOB, formation irregularities and material differences, and vibration. These conditions can result in damage to the cutting surface (e.g., chipping, spalling). Such damage often occurs at or near the cutting edge of the cutting surface and is caused, at least in part, by the high impact forces that occur during drilling. Damage to the cutting element results in decreased cutting efficiency of the cutting element. When the efficiency of the cutting element decreases to a critical level the operation must be stopped to remove and replace the drill bit which is a large expense for an operation utilizing earth-boring tools.

Securing a PDC cutting element to a drill bit restricts the useful life of such cutting element. As the cutting edge of the diamond table and the substrate wear down a so-called "wear flat" is created necessitating increased weight on bit to maintain a given rate of penetration of the drill bit into the formation due to the increased surface area presented. In addition, more than half of the cutting element is never used unless the cutting element is heated to remove it from the bit and then rebrazed with an unworn portion of the cutting edge presented for engaging a formation.

Attempts have been made to configure cutting elements to rotate such that the entire cutting edge extending around each cutting element may selectively engage with and remove material. By utilizing the entire cutting edge, the effective life of the cutting element may be increased. Many designs for rotating cutting elements allow the cutting element to freely rotate even when under a cutting load. Rotating under a load results in wear on internal surfaces exposing the cutting element to vibration which can damage the cutting elements reducing their life, and may result in uneven wear on the cutting edge of the cutting element.

BRIEF SUMMARY

In some embodiments, the present disclosure includes a rotatable cutter for use on an earth-boring tool. The rotatable cutter may comprise a rotatable element and a stationary element. The rotatable element may include a cutting surface and a first interface surface on respective sides of a support structure. The stationary element may be coupled to the rotatable element. The rotatable element may be configured to move relative to the stationary element along a longitudinal axis of the rotatable cutter. The stationary element may have a second interface surface. The first interface surface of the rotatable element and the second interface surface of the stationary element may define a releasable interface. The releasable interface may be configured to substantially inhibit rotation of the rotatable element when the two surfaces are at least in partial contact.

In additional embodiments, the present disclosure includes an earth-boring tool. The earth-boring tool may have at least one rotatable element fixed thereto. The rotatable element comprises a movable element, a sleeve element, and an engagement feature. The movable element may include a surface to engage a portion of a subterranean borehole, and a shoulder. The movable element may be at least partially disposed within the sleeve element, and configured to "float" over the sleeve element in a direction along a longitudinal axis of the movable element. The movable element may also rotate about the longitudinal axis of the rotatable element. There may be at least a portion of the movable element spaced from the sleeve element. The engagement feature may be positioned on at least one of the shoulder of the movable element or the sleeve element. The engagement feature may be configured to at least partially inhibit rotation of the movable element relative to the sleeve element when the shoulder of the movable element contacts the sleeve element.

Further embodiments of the present disclosure include a method for at least partially inhibiting the rotation of a rotatable cutting element on an earth-boring tool. The method includes moving a cutting element along a longitudinal axis of the rotatable cutting element within a sleeve element. A first engagement surface of the cutting element may be engaged with a second engagement surface of the sleeve element. The cutting element may be arrested by at least one of a frictional engagement or an interference engagement between the first engagement surface and the second engagement surface.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring tool, rotatable cutting element or component thereof, but are merely idealized representations employed to describe illustrative embodiments. The drawings are not necessarily to scale.

Disclosed embodiments relate generally to rotatable elements (e.g., cutting elements) for earth-boring tools that may rotate in order to alter the positioning of the cutting element relative to an earth-boring tool to which the cutting element is coupled. For example, such a configuration may enable the cutting element to present a continuously sharp cutting edge with which to engage a downhole formation while still occupying substantially the same amount of space as conventional fixed cutting elements. Some embodiments of such rotatable cutting elements may include a stationary element, a rotatable element, and a releasable interface between a surface of the rotatable cutting element and a surface of the stationary element. The releasable interface may act to substantially inhibit the rotatable cutting element from rotating relative to the stationary element when the surface of the rotatable cutting element is in contact with the surface of the stationary element.

Such rotatable elements may be implemented in a variety of earth-boring tools, such as, for example, rotary drill bits, percussion bits, core bits, eccentric bits, bi-center bits, reamers, expandable reamers, mills, drag bits, roller cone bits, hybrid bits, and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
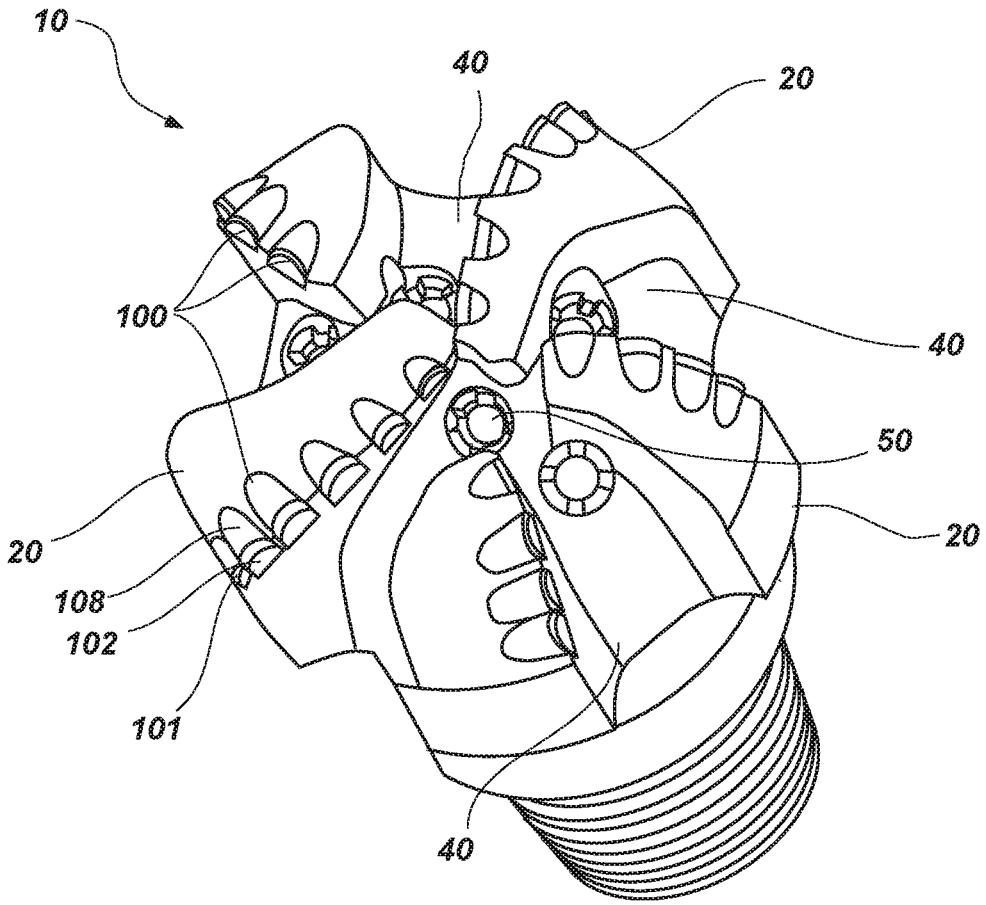
FIG. 1 illustrates a fixed-cutter earth-boring tool commonly known as a "drag-bit," in accordance with embodiments of the present disclosure.

Referring to FIG. 1, a perspective view of an earth-boring tool 10 is shown. The earth-boring tool 10 may have blades 20 in which a plurality of cutting elements 100 may be secured. The cutting elements 100 may have a cutting table 101 with a cutting surface 102, which may form the cutting edge of the blade 20. The earth-boring tool 10 may rotate about a longitudinal axis of the earth-boring tool 10. When the earth-boring tool 10 rotates, the cutting surface 102 of the cutting elements 100 may contact the earth formation and remove material. The material removed by the cutting surfaces 102 may then be removed through the junk slots 40. The earth-boring tool 10 may include nozzles 50, which may introduce drilling fluid, commonly known as drilling mud, into the area around the blades 20 to aid in removing the sheared material and other debris from the area around the blades to increase the efficiency of the earth-boring tool 10.

In applications where the cutting elements 100 are fixed, only the edge of the cutting surface 102 of the cutting elements 100 that is exposed above the surface of the blade 20 will contact the earth formation and wear down during use. By rotating the cutting element 100, relatively more of (e.g., a majority of, a substantial entirety of) the edge of the cutting surface 102 may be exposed to wear and may act to extend the life of the cutting element 100.

In applications where the cutting elements 100 are allowed to rotate while actively engaging the earth formation wear may occur on the internal parts of the cutting elements 100. Internal wear may impede rotation or cause vibration, both of which may cause the cutting element 100 to fail prematurely. Inhibiting the rotation of the cutting element 100 while the cutting element 100 is actively engaging the earth formation, in accordance to embodiment disclosed herein, may further extend the life of the cutting element 100.

Figure 2:
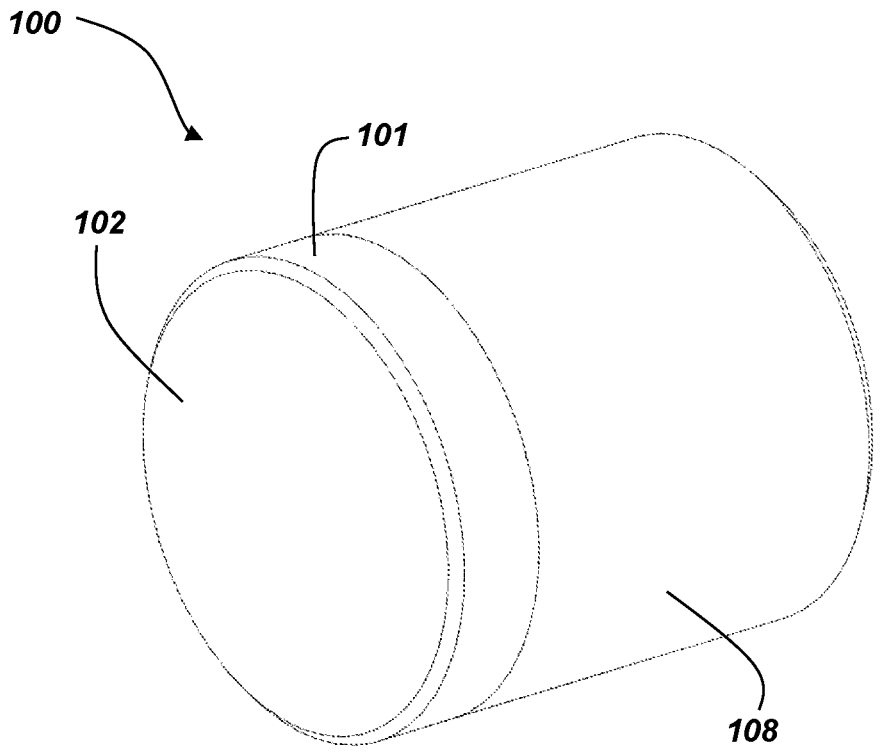
FIG. 2 is an isometric view of a rotatable cutter in accordance with an embodiment of the present disclosure.

Referring to FIG. 2, a perspective view of an embodiment of a rotatable cutting element 100 is shown. The rotatable cutter 100 may comprise the cutting table 101 with the cutting surface 102 and a substrate 108. The rotatable cutter 100 may be secured to the earth-boring tool 10 (FIG. 1) by fixing the exterior surface of the substrate 108 to the earth-boring tool 10. This is commonly achieved through a brazing process.

Figure 3:
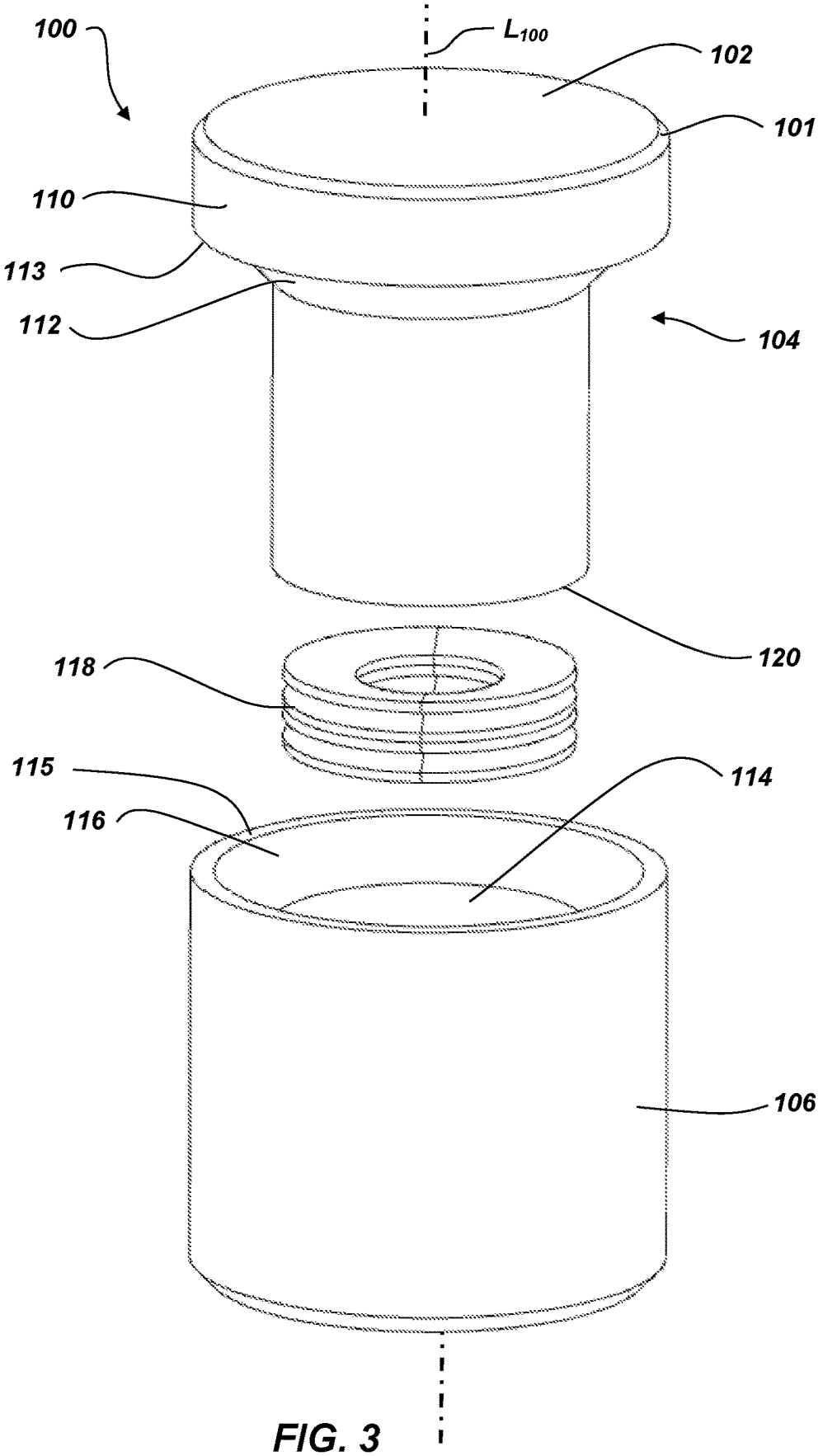
FIG. 3 is an exploded view of a rotatable cutter in accordance with embodiments of the present disclosure.

Referring to FIG. 3, an exploded view of an embodiment of a rotatable cutter 100 is shown. The rotatable cutter 100 may include at least two components. For example, the rotatable cutter 100 may comprise a cutting element 104 portion (e.g., a rotatable element, a movable element, a cutting element portion) and a stationary element 106 (e.g., a sleeve element). The cutting element 104 may be disposed at least partially within the stationary element 106.

In some embodiments, the rotatable element 104 may comprise a surface configured to engage a portion of a subterranean borehole (e.g., a cutting surface 102), a support structure 110, and a shoulder 112 (e.g., first interface surface, or first engagement surface). The cutting surface 102 may be formed from a polycrystalline material, such as, polycrystalline diamond or polycrystalline cubic boron nitride. The support structure 110 of the rotatable element 104 may be formed from a hard material suitable for use in a subterranean borehole, such as, for example, a metal, alloy (e.g., steel), or ceramic-metal composite (e.g., cobalt-cemented tungsten carbide). The cutting surface 102 may be positioned on a first side of the support structure 110, such that the cutting surface 102 may engage a portion of the subterranean borehole. The shoulder 112 may be positioned on a second side of the support structure 110, opposite the cutting surface 102. In some embodiments, the cutting surface 102 may be larger in diameter than the base 120 of the rotatable element 104. In some embodiments, the support structure 110 may be the same diameter as the cutting surface 102. The shoulder 112 may exhibit a chamfered (e.g., tapered, or conical) surface between the larger diameter of the support structure 110 and the smaller diameter of the base 120. In some embodiments, at least a portion of the shoulder 112 may be substantially parallel (e.g., not tapered) to the cutting surface 102. For example, a shoulder surface 113 may extend around the outer circumference of the shoulder 112. The parallel shoulder surface 113 may rest against a top surface 115 of the stationary element 106 when the rotatable element 104 is fully disposed within the stationary element 106. In some embodiments, a majority of (e.g., a substantial entirety of, more than half of) the shoulder 112 may comprise the parallel shoulder surface 113. In some embodiments, the majority of the shoulder 112 may comprise a chamfered surface, as demonstrated in FIG. 3.

In some embodiments, the stationary element 106 may be formed from a hard material, such as, for example, a metal, alloy, or ceramic-metal composite. The stationary element 106 may define a void 114 (e.g., a cavity, or a bore). The stationary element 106 may have a second interface surface 116 (e.g., a second engagement surface). The second interface surface 116 may come into contact with the shoulder 112 of the rotatable element 104. The second interface surface 116 may be complementary to the surface of the shoulder 112. For example, the second interface surface 116 may have a complementary chamfer (e.g., taper, conical shape) to the surface of the shoulder 112.

In some embodiments, the stationary element 106 and the rotatable element 104 may be coupled to one another by any suitable manner. For example, the rotatable element 104 may be coupled to the stationary element 106 with a retention element rotatably coupling the rotatable element 104 to the stationary element 106 through an internal passage. Such a retention element is disclosed in, for example, U.S. patent application Ser. No. 15/663,530, filed Jul. 28, 2017, and titled "CUTTING ELEMENT ASSEMBLIES AND DOWNHOLE TOOLS COMPRISING ROTATABLE CUTTING ELEMENTS AND RELATED METHODS," the disclosure of which is incorporated herein in its entirety by this reference. Other embodiments may include a track with retention pins such as those disclosed in, for example, U.S. patent application Ser. No. 15/662,626, filed Jul. 28, 2017, and titled "ROTATABLE CUTTERS AND ELEMENTS FOR USE ON EARTH-BORING TOOLS IN SUBTERRANEAN BOREHOLES, EARTH-BORING TOOLS INCLUDING SAME, AND RELATED METHODS," the disclosure of which is incorporated herein in its entirety by this reference.

The rotatable element 104 may be configured to move (e.g., float, or slide) relative to the stationary element 106. The rotatable element 104 may move longitudinally along the longitudinal axis $L_{100}$ of the rotatable cutter 100. In some embodiments, the second interface surface 116 of the stationary element 106 may be configured to limit the longitudinal movement of the rotatable element 104. For example, when the cutting surface 102 is engaged with an earth formation the rotatable element 104 may be displaced into the stationary element 106 along the longitudinal axis $L_{100}$ of the rotatable cutter 100 until the shoulder 112 contacts the second interface surface 116.

In some embodiments, a biasing element 118 (e.g., a motivating element) may be interposed between the stationary element 106 and the rotatable element 104. The biasing element 118 may be configured to bias the rotatable element 104 in a direction away from the stationary element 106 along the longitudinal axis $L_{100}$ of the rotatable cutter 100. Examples of biasing elements 118 that may be used, by way of example but not limitation, are springs, washers (e.g., Bellville washers), compressible fluids, magnetic biasing, resilient materials, or combinations thereof. In some embodiments, the biasing element 118 may provide a constant force against the base 120 of the rotatable element 104. For example, when the cutting surface 102 is engaged with an earth formation, there may be an external force exerted on the cutting surface 102 counter to the force of the biasing element 118. The external force may overcome the biasing element 118 and displace the rotatable element 104 into the stationary element 106 until the shoulder 112 contacts the second interface surface 116. When the cutting surface 102 is disengaged from the earth formation, the force from the biasing element 118 may move the rotatable element 104 along the longitudinal axis $L_{100}$ of the rotatable cutter 100 into a position at least partially spaced from the stationary element 106.

In some embodiments, the rotatable element 104 may rotate about the longitudinal axis $L_{100}$ of the rotatable cutter 100. The rotatable element 104 may freely rotate when the shoulder 112 and the second interface surface 116 are separated. For example, when the cutting surface 102 is disengaged from the earth formation. In some embodiments, the shoulder 112 and the second interface surface 116 may define a frictional and/or mechanical interference engagement feature (e.g., a releasable interface) configured to substantially inhibit rotation of the rotatable element 104 with respect to the stationary element 106 when the shoulder 112 and the second interface surface 116 are placed in at least partial contact.

In some embodiments, the engagement feature may include a high friction coating, such as, an abrasive coating (e.g., metal filings, metal oxides, ceramic materials, etc.), a rubberized coating, or other similar high friction coatings. The high friction coating may be applied to at least one of the shoulder 112 or the second interface surface 116. In some embodiments, the high friction coating may be applied to both the shoulder 112 and the second interface surface 116.

Figure 4:
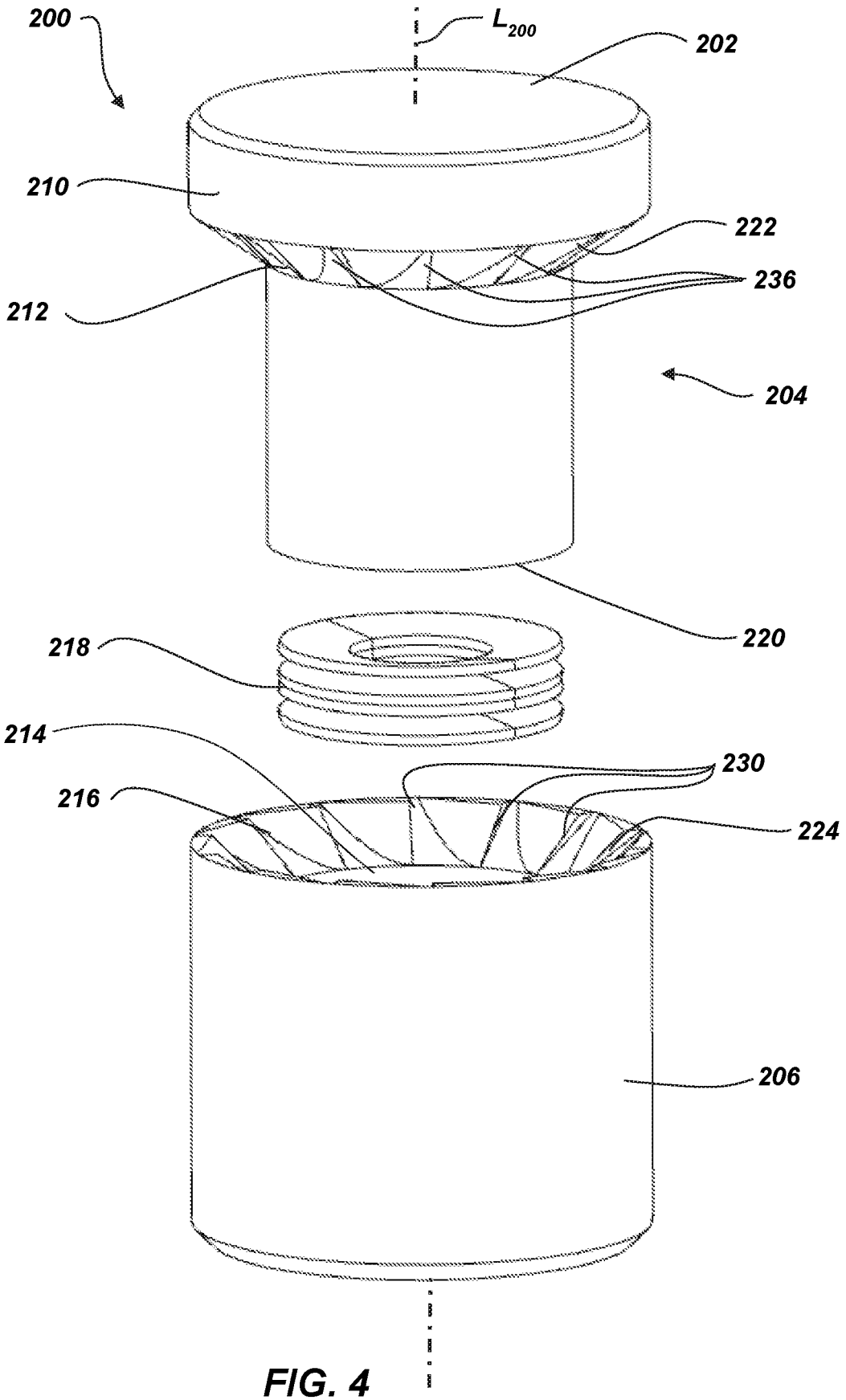
FIG. 4 is an exploded view of a rotatable cutter in accordance with another embodiment of the present disclosure.

Referring to FIG. 4, an exploded view of an embodiment of a rotatable cutter 200 is shown. The rotatable cutter 200 may be similar to rotatable cutter 200 and may include similar features and functionality. For example, rotatable cutter 200 may comprise at least two components, a movable element 204 (e.g., a rotatable element) and a sleeve element 206 (e.g., a stationary element). The movable element 204 may comprise a cutting surface 202 on a first side of a support structure 210 and a first engagement surface 212 (e.g., a shoulder, or a first interface surface) on a second side of the support structure 210. The cutting surface 202 may be formed from a polycrystalline material, such as, polycrystalline diamond or polycrystalline cubic boron nitride. The support structure 210 of the movable element 204 may be formed from a hard material, such as, for example, a metal, alloy, or ceramic-metal composite.

The movable element 204 may be at least partially disposed within the sleeve element 206. The sleeve element 206 may be formed from a hard material, such as, a metal, alloy, or ceramic-metal composite. The sleeve element 206 may have a second engagement surface 216 (e.g., a second interface surface). The first engagement surface 212 and the second engagement surface 216 may have complementary geometry (e.g., taper, chamfer, or conical shape).

In some embodiments, the first engagement surface 212 and the second engagement surface 216 may define an engagement feature (e.g., a frictional and/or interference feature). The engagement feature may comprise opposing patterns configured to interact with each other. For example, the engagement feature may include a pattern of ridges 222, 224 (e.g., teeth, protrusions, detents, waves, undulations, zigzag shapes, or combinations thereof) positioned one or more of the first engagement surface 212 and the second engagement surface 216. The pattern of ridges 222, 224 may be configured to at least partially inhibit rotation of the movable element 204 when the first engagement surface 212 contacts the second engagement surface 216.

In some embodiments, the pattern of ridges 222, 224 may be positioned on both the first engagement surface 212 and the second engagement surface 216. The pattern of ridges 222, 224 may be configured such that a first pattern of ridges 222 positioned on the first engagement surface 212 is complementary to a second pattern of ridges 224 on the second engagement surface 216. For example, when the first engagement surface 212 is proximate to the second engagement surface 216 the first pattern of ridges 222 may interlock with the complementary second pattern of ridges 224. Once interlocked, the first pattern of ridges 222 and the second pattern of ridges 224 may substantially inhibit the rotation of the movable element 204 relative to the sleeve element 206.

In some embodiments, the first pattern of ridges 222 and second pattern of ridges 224 may be configured to enable the movable element 204 to incrementally rotate. The first pattern of ridges 222 and the second pattern of ridges 224 may be configured to interlock at specific intervals. The specific number of the intervals may be defined by a number of ridges 236, 230 in the first pattern of ridges 222 and the second pattern of ridges 224. In some embodiments, the first pattern of ridges 222 may have the same number of ridges 236 as the second pattern of ridges 224. In other embodiments, the first pattern of ridges 222 may have less than (e.g., half) the number of ridges 236 as compared to the ridges 230 in the second pattern of ridges 224. In another embodiment, the first pattern of ridges 222 may have more than (e.g., double) the number of ridges 236 as the second pattern of ridges 224. The number of ridges 230, 236, as well as the angular spacing of the ridges 230, 236 may define the increment that the movable element 204 may rotate relative to the sleeve element 206.

In some embodiments, a motivating element 218 (e.g., a biasing element) may be configured to slide the movable element 204 along the longitudinal axis $L_{200}$ of the rotatable cutter 200. The motivating element 218 may act on base 220 of the movable element 204 sliding the movable element 204 away from the sleeve element 206. In some embodiments, the force of the cutting surface 202 engaging the borehole may slide the movable element 204 until the first engagement surface 212 contacts the second engagement surface 216. When the cutting surface 202 is disengaged from the borehole the motivating element 218 may introduce a space between the first engagement surface 212 and the second engagement surface 216. In some embodiments, the space may disengage the first pattern of ridges 222 from the interlocked engagement with the second pattern of ridges 224.

Figure 5A:
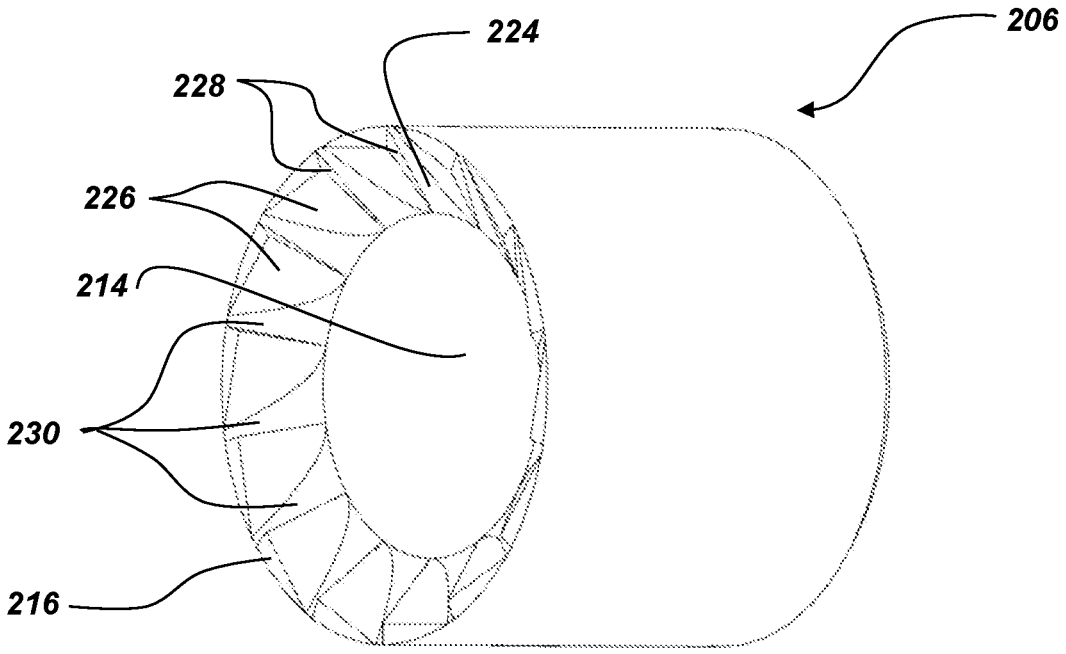
FIG. 5A is an isometric view of a stationary element in accordance with an embodiment of the present disclosure.
Figure 5B:
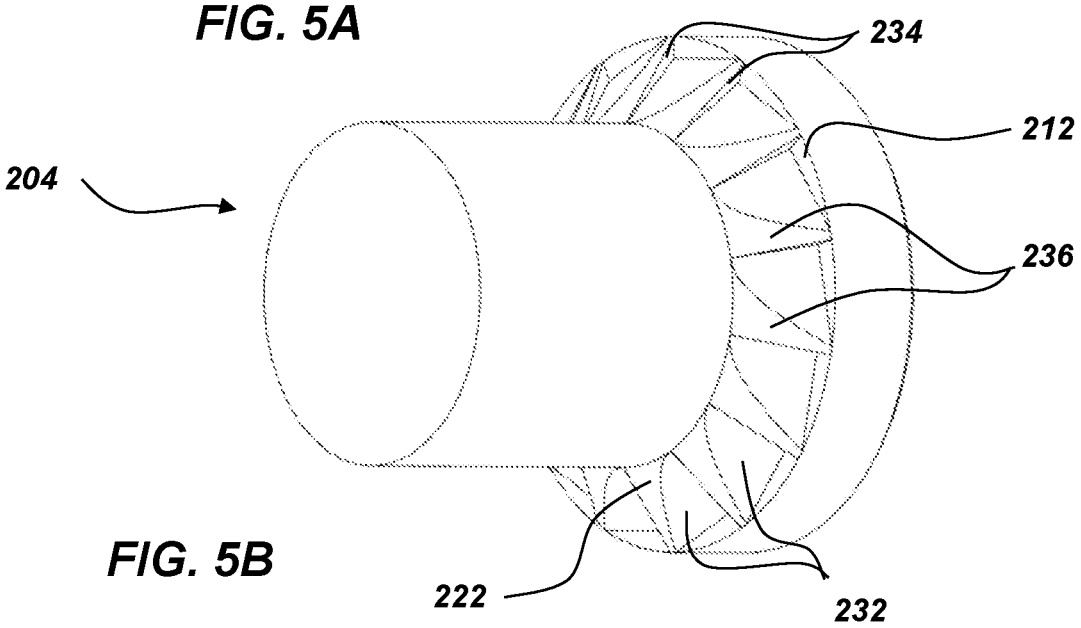
FIG. 5B is an isometric view of a movable element in accordance with an embodiment of the present disclosure.

Referring to FIGS. 5A and 5B, isometric views of the sleeve element 206 and the movable element 204, respectively, are shown. In some embodiments, the first pattern of ridges 222 located on the first engagement surface 212 may be configured with indexing planes 232 and arresting planes 234 which may define each ridge 236 in the pattern of ridges 222. The second pattern of ridges 224 located on the second engagement surface 216 may have a complementary configuration. The second pattern of ridges 224 may have complementary indexing planes 226 and complementary arresting planes 228 which may define each complementary ridge 230 in the second pattern of ridges 224.

In some embodiments, the movable element 204 may rotate relative to the sleeve element 206. The interaction between the first pattern of ridges 222 and the second pattern of ridges 224 may cause the rotation to occur incrementally. For example, when the rotatable cutter 200 engages an earth formation, the movable element 204 may move into the sleeve element 206 along the longitudinal axis $L_{100}$ of the rotatable cutter 200 until the first engagement surface 212 rests against the second engagement surface 216. When the first engagement surface 212 initially contacts the second engagement surface 216, the indexing planes 232 and the complementary indexing planes 226 may cause the movable element 204 to rotate. The arresting planes 234 and the complementary arresting planes 228 may stop (e.g., arrest, inhibit) the rotation of the movable element 204 when arresting planes 234 and the complementary arresting planes 228 rest against one another. When the rotatable cutter 200 disengages the earth formation, the biasing element 218 (FIG. 4) may move the movable element 204 in a direction out of the sleeve element 206 such that the first engagement surface 212 is no longer in contact with second engagement surface 214. This movement allows the movable element 204 to move to the next indexing plane 232, 226. The number and spacing of the ridges 230, 236 in the second pattern of ridges 224 and the first pattern of ridges 222 may define the incremental rotation of the movable element 204.

Embodiments of rotatable cutter described herein may improve the wear characteristics on the cutting elements of the rotatable cutters. Such rotatable cutters with a feature to at least partially inhibit rotation when the rotatable cutter is under a load may reduce the wear on internal components of the rotatable cutter. Reducing the wear on the internal components may, in turn, reduce the wear on the associated cutting element.

Embodiments of the disclosure may be particularly useful in providing a cutting element with improved wear characteristics of a cutting surface that may result in a longer service life for the rotatable cutting elements. Extending the life of the rotatable cutting elements may, in turn, extend the life of the earth-boring tool to which they are attached. Replacing earth-boring tools or tripping out an earth-boring tool to replace worn or damaged cutters is a large expense for downhole earth-boring operations. Often earth-boring tools are on a distal end of a drill string that can be in excess of 40,000 feet long. The entire drill string must be removed from the borehole to replace the earth-boring tool or damaged cutters. Extending the life of the earth-boring tool may result in significant cost savings for the operators of a downhole earth-boring operation.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A rotatable cutter for use on an earth-boring tool in a subterranean borehole, comprising:

a rotatable element comprising:

a cutting surface positioned on a first side of a support structure; and a first interface surface on a second side of the support structure the first interface surface comprising at least one indexing surface and at least one arresting surface;

a stationary element coupled to the rotatable element, the rotatable element configured to move relative to the stationary element along a longitudinal axis of the rotatable cutter, the stationary element comprising a radially tapered second interface surface of the rotatable cutter, the radially tapered second interface surface comprising at least one complementary indexing surface and at least one complementary arresting surface extending radially along the radially tapered second interface surface, wherein the first interface surface of the rotatable element and the radially tapered second interface surface of the stationary element define a releasable interface configured to:

substantially inhibit rotation of the rotatable element when the first interface surface and the radially tapered second interface surface are placed in at least partial contact through contact between the at least one arresting surface and the at least one complementary arresting surface; and enable the rotatable element to freely rotate about the longitudinal axis of the rotatable cutter when the first interface surface and the radially tapered second interface surface are separated; and a biasing element configured to separate the rotatable element from the stationary element.

2. The rotatable cutter of claim 1, wherein the rotatable element is configured to freely rotate about the longitudinal axis of the rotatable cutter until the first interface surface and the radially tapered second interface surface are engaged.

3. The rotatable cutter of claim 1, further comprising a high friction coating on at least one of the first interface surface or the radially tapered second interface surface.

4. The rotatable cutter of claim 1, wherein the first interface surface comprises a tapered surface.

5. The rotatable cutter of claim 1, wherein the first interface surface comprises a complementary tapered surface to the radially tapered second interface surface.

6. The rotatable cutter of claim 1, wherein the releasable interface comprises a first tooth pattern on the first interface surface and a second complementary tooth pattern on the radially tapered second interface surface, the first tooth pattern configured to interlock with the second complementary tooth pattern when the first interface surface and the radially tapered second interface surface are positioned proximate to each other.

7. The rotatable cutter of claim 6, wherein the first tooth pattern and the second complementary tooth pattern are configured to interlock at intervals defined by the first tooth pattern and the second complementary tooth pattern to enable the rotatable element to incrementally rotate between the intervals.

8. The rotatable cutter of claim 1, wherein the biasing element is configured to move the first interface surface to a location where the first interface surface is no longer in contact with the radially tapered second interface surface.

9. The rotatable cutter of claim 8, wherein the biasing element is configured to bias the rotatable element in a position at least partially spaced from the stationary element.

10. An earth-boring tool comprising:

at least one rotatable element fixed to the earth-boring tool, comprising:

a movable element comprising:

a surface configured to engage a portion of a subterranean borehole; and a shoulder;

a sleeve element comprising a shoulder, the movable element disposed at least partially within the sleeve element, the movable element configured to float over the sleeve element in a direction along a longitudinal axis of the rotatable element where at least a portion of the movable element is spaced from the sleeve element, the movable element further configured to freely rotate about the longitudinal axis of the rotatable element; and an engagement feature comprising one of a concave surface or a convex surface extending radially along the at least one rotatable element at an oblique angle, the one of the concave surface or the convex surface positioned on the shoulder of each of the movable element or the sleeve element, the engagement feature comprising at least one indexing surface extending radially along at least one of the concave surface or the convex surface, the at least one indexing surface configured to cause rotation of the movable element responsive to forces applied to the rotatable element when using the earth-boring tool until the engagement feature reaches at least one arresting surface extending radially along at least one of the concave surface or the convex surface, the at least one arresting surface configured to at least partially inhibit rotation of the movable element relative to the sleeve element when the concave surface is brought into contact with the convex surface.

11. The earth-boring tool of claim 10, further comprising a motivating element interposed between the movable element and the sleeve element configured to at least partially space the movable element from the sleeve element in an unloaded position.

12. The earth-boring tool of claim 11, wherein the motivating element is configured to slide the movable element along the longitudinal axis of the sleeve element at least to a position where the shoulder of the movable element is spaced from the stationary sleeve element.

13. The earth-boring tool of claim 10, wherein the engagement feature comprises a pattern of ridges positioned on at least one of the shoulder of the movable element or the sleeve element.

14. The earth-boring tool of claim 13, wherein the pattern of ridges further comprises a first pattern of ridges on the shoulder and a second pattern of ridges on the sleeve element.

15. The earth-boring tool of claim 14, wherein the pattern of ridges is configured to substantially inhibit rotation of the movable element at intervals defined by the pattern of ridges.

16. The earth-boring tool of claim 10, wherein the shoulder of the movable element comprises the convex surface and the shoulder of the sleeve element comprising the concave surface.

17. A method of at least partially inhibiting rotation of a rotatable cutting element on an earth-boring tool for use in a subterranean borehole, the method comprising:

moving a cutting element portion along a longitudinal axis of the rotatable cutting element within a sleeve element;

engaging a first engagement surface of the cutting element portion with a radially tapered second engagement surface of the sleeve element, wherein the radially tapered second engagement surface comprises at least one indexing surface and at least one arresting surface;

arresting the cutting element portion with the at least one arresting surface when the first engagement surface of the cutting element portion is in contact with the radially tapered second engagement surface of the sleeve element;

biasing the cutting element portion away from the sleeve element; and enabling the cutting element portion to freely rotate when the first engagement surface and the radially tapered second engagement surface are separated.

18. The method of claim 17, wherein biasing the cutting element portion away from the sleeve element comprises directly contacting the cutting element portion with a biasing element.

19. The method of claim 17, wherein arresting the cutting element portion comprises engaging a first conical surface of the cutting element portion with a complementary conical surface of the sleeve element.

20. The method of claim 17, further comprising wherein arresting the cutting element portion comprises engaging a high friction material on one of the first engagement surface or the radially tapered second engagement surface with a surface on the other of the first engagement surface or the radially tapered second engagement surface.

* * * * *